United States Patent [19]

Skinner et al.

[11] Patent Number: 4,661,172

[45] Date of Patent: Apr. 28, 1987

[54] LOW DENSITY ALUMINUM ALLOYS AND METHOD

[75] Inventors: David J. Skinner, Flanders; Kenji Okazaki, Basking Ridge; Colin M. Adam, Morristown, all of N.J.

[73] Assignee: Allied Corporation, Morris Township, Morris County, N.J.

[21] Appl. No.: 584,856

[22] Filed: Feb. 29, 1984

[51] Int. Cl.[4] ..... C22F 1/04

[52] U.S. Cl. ..... 148/12.7 A; 75/249; 148/11.5 A; 148/11.5 P; 148/415; 148/416; 148/417; 148/418; 148/438; 148/439; 148/440; 420/902

[58] Field of Search ..... 420/543, 544, 545, 533–535, 420/902; 148/11.5 P, 11.5 A, 12.7 A, 415–418, 437–440; 75/249

[56] References Cited

U.S. PATENT DOCUMENTS 4,347,076 8/1982 Ray et al. ..... 148/437

OTHER PUBLICATIONS

Tietz and Palmer, "Advanced P/M Aluminum Alloys", 1981, pp. 206–211.

D. B. Williams, "Aluminum–Lithium Alloys", Proc. 1981 Conference, pp. 89–100.

Sahin, et al., "Extended Solid Solubility, Grain Refinement and Age-Hardening in Al-1, to 13 wt % Zr Rapidly Quenched from the Melt", 1978, pp. 138–146.

*Primary Examiner*—R. Dean

*Attorney, Agent, or Firm*—Ernest D. Buff; Gerhard H. Fuchs

[57] ABSTRACT

The present invention provides a low density aluminum-base alloy, consisting essentially of the formula $Al_{bal}Zr_aLi_bMg_cT_d$, wherein T is at least one element selected from the group consisting of Cu, Si, Sc, Ti, V, Hf, Be, Cr, Mn, Fe, Co and Ni, "a" ranges from about 0.25–2 wt %, "b" ranges from 2.7–5 wt %, "c" ranges from about 0.5–8 wt %, "d" ranges from about 0.5–5% and the balance is aluminum. The alloy has a primary, cellular-dendritic, fine-grained, supersaturated aluminum alloy solid solution phase with intermetallic phases of the constituent elements uniformly dispersed therein. A consolidated article can be produced by compacting together particles composed of the aluminum alloy of the invention in a vacuum at elevated temperature. The compacted alloy is solutionized by heat treatment, quenched in a fluid bath, and optionally, stretched and aged. The microstructure of the consolidated article is composed of an aluminum solid solution containing a substantially uniform distribution of fine intermetallic precipitates.

53 Claims, 8 Drawing Figures

2000 Å

2000 Å

1000Å

LOW DENSITY ALUMINUM ALLOYS AND METHOD

DESCRIPTION

1. Field of the Invention

The invention relates to aluminum metal alloys having reduced density. More particularly, the invention relates to aluminum-lithium-zirconium powder metallurgy alloys that are capable of being rapidly solidified from the melt and then thermomechanically processed into structural components having a combination of high ductility (toughness) and high tensile strength to density ratio (specific strength).

2. Brief Description of the Prior Art

The need for structural aerospace alloys of improved specific strength has long been recognized, culminating in 1980 in a series of presentations to the National Materials Advisory Board which resulted in the publication of the report NMAB-368, "Rapidly Solidified Aluminum Alloys-Status and Prospects" in 1981. This report suggested various alloying elements, such as beryllium, magnesium and lithium, which would decrease the density of aluminum alloys. The report, however, also showed that maintaining strength and toughness of these alloys at desired levels would be technically difficult.

Research has identified alloy compositions with adequate strength for structural applications. These alloys, however, had inadequate ductility and toughness. The combinations of properties exhibited by these alloys have been summarized by Tietz and Palmer in "Advanced P/M Aluminum Alloys", Advances in Powder Technology, A.S.M. (1981), page 189. Some alloys produced have demonstrated uniaxial plastic tensile elongations of 10–12% at tensile strength levels of 550 MPa (80 ksi). These alloys, however, have had densities of at least about 2.8 grams/cc.

It has been recognized that the elements lithium, beryllium, boron and magnesium could be added to aluminum alloys to decrease the density. However, current methods of production of aluminum alloys, such as direct chill (DC) continuous and semi-continuous casting, cannot satisfactorily produce alloys containing more than about 2.5 wt % lithium or about 0.2 wt % boron. Magnesium and beryllium contents up to 5 wt % have been satisfactorily included in aluminum alloys by DC casting, but the alloy properties have generally not been adequate for widespread use in applications requiring a combination of high strength and low density. More particularly, conventional aluminum alloys have not provided the desired combination of low density, high strength and toughness.

The microstructural characteristics of binary aluminum-lithium alloys, containing up to about 25 atom lithium, have been described by Williams (D. B. Williams, "Aluminum-Lithium Alloys", Proc. 1981 Conference, Metallurgical Soc. of AIME, pp. 89–100). The phase responsible for strengthening binary alloys is the ordered metastable $Ll_2$ phase $Al_3Li$ ($\delta'$) which has a well defined $\delta'$ solvus line. At temperatures below this solvus line, the $\delta'$ phase is in metastable equilibrium with the aluminum matrix; at temperatures above this solvus line, the equilibrium AlLi phase ($\delta$) is stable. The $\delta'$ phase is reported to nucleate homogeneously from the supersaturated solution, and is the phase responsible for modest strengthening in these alloys.

Extended solubility, grain refinement and age hardening in aluminum alloys containing 1–13 wt % zirconium in binary alloys rapidly quenched from the melt have been studied by Sahin and Jones (Rapidly Quenched Metals III, Volume 1, 1978, page 138, The Metals Society, London). Sahin, et al. found that aluminum rich, binary Al-Zr alloys quenched from the melt at about $10^{6°}$ C./sec form extended solid solutions apparently free of solute clustering effects up to zirconium contents cf at least about 9.4 wt % zirconium (3 atom percent). The aluminum-zirconium alloys appear to have a high resistance to quench clustering and a significant age hardening response produced by precipitation of a metastable ordered $Ll_2$ phase. $Al_3Zr$. This phase is essentially isostructural with $\delta'$ $Al_3Li$.

Attempts have been made to employ a ternary ordered phase, $Al_3(Li, Zr)$ to strengthen Al-Li-Zr alloys. However, zirconium solid solution alloy contents greater than about 0.2 wt % generally had not been possible in aluminum alloys produced by conventional casting because the slow alloy cooling rate involved in such processes produce massive, 10–50 micrometer in size, primary $Al_3Zr$ particles in the alloy. The presence of such particles reduces ductility and toughness, and removes zirconium from the alloy solid solution where its effect is most beneficial. As a result, Al-Li-Zr alloys heretofore had contained less than the optimum amount of Zr required to produce the desired combination of high strength, high toughness (ductility) and low density.

The inclusion of the elements lithium and magnesium, singly or in concert, may impart higher strength and lower density to the alloys, but they are not of themselves sufficient to produce ductility and high fracture toughness without other secondary elements. Such secondary elements, such as copper and zinc, provide improved precipitation hardening response; zirconium can additionally provide grain size control by pinning grain boundaries during thermomechanical processing; and elements such as silicon and transition metal elements can provide improved thermal stability at intermediate temperatures up to about 200° C. However, combining these elements in aluminum alloys had been difficult because of their reactive nature in liquid aluminum which encourages the formation of coarse, complex intermetallic phases during conventional casting. Such coarse phases, ranging from about 1–20 micrometers in size, are detrimental to crack sensitive mechanical properties, like fracture toughness and ductility, by encouraging fast crack growth under tensile loading.

Thus, considerable effort has been directed to producing low density aluminum based alloys capable of being formed into structural components. However, conventional alloys and techniques, such as discussed above, had been unable to provide the desired combination of high strength, toughness and low density. As a result, conventional aluminum based alloys have not been entirely satisfactory for structural applications requiring high strength, good ductility and low density, such as required in aircraft structural components.

SUMMARY OF THE INVENTION

The invention provides a low density aluminum-base alloy, consisting essentially of the formula $Al_{bal}Zr_aLi_bMg_cT_d$, wherein T is at least one element selected from the group consisting of Cu, Si, Sc, Ti, V, Hf, Cr, Mn, Fe, Co and Ni, "a" ranges from about 0.25–2 wt %, "b" ranges from about 2.7–5 wt %, "c" ranges from about 0.5–8 wt %, "d" ranges from about 0.5–5% and the balance is aluminum.

The invention also provides a method for producing a low density, aluminum-lithium-zirconium alloy, consolidated article. The method includes the step of compacting together particles composed of a low density aluminum-lithium-zirconium alloy, consisting essentially of the formula $Al_{bal}Zr_aLi_bMg_cT_d$, wherein T is at least one element selected from the group consisting of Cu, Si, Sc, Ti, V, Hf, Be, Cr, Mn, Fe, Co and Ni, "a" ranges from about 0.25–2 wt %, "b" ranges from about 2.7–5 wt %, "c" ranges from about 0.5–8 wt %, "d" ranges from about 0.5–5% and the balance is aluminum. The alloy has a primary, cellular dendritic, fine-grained, super saturated aluminum alloy solid solution phase with filamentary, intermetallic phases of the constituent elements uniformly dispersed therein. These intermetallic phases have width dimensions of not more than about 100 nm. Comminuted alloy particles are heated during the compacting step to a temperature of not more than about 400° C. to minimize coarsening of the intermetallic phase. The compacted alloy is solutionized by heat treatment at a temperature ranging from about 500° to 550° C. for a period of approximately 0.5 to 5 hours, quenched in a fluid bath held at approximately 0°–80° C., and optionally, aged at a temperature ranging from about 100° to 250° C. for a period ranging from about 1 to 40 hours.

The consolidated article of the invention has a distinctive microstructure composed of an aluminum solid solution containing therein a substantially uniform dispersion of intermetallic precipitates. These precipitates are composed essentially of fine intermetallics measuring not more than about 20 nm along the largest linear dimension thereof. In addition, the article of the invention has a density of not more than about 2.6 grams/cc, an ultimate tensile strength of at least about 500 MPa and has an ultimate tensile strain to fracture of about 5% elongation, all measured at room temperature (about 20° C.).

Thus, the invention provides distinctive aluminum-base alloys that are particularly capable of being formed into consolidated articles that have a combination of high strength, toughness and low density. The method of the invention advantageously minimizes coarsening of zirconium rich, intermetallic phases within the alloy to increase the ductility of the consolidated article, and maximizes the amount of zirconium held in the aluminum solid solution phase to increase the strength and hardness of the consolidated article. As a result, the article of the invention has an advantageous combination of low density, high strength, high elastic modulus, good ductility and thermal stability. Such alloys are particularly useful for lightweight structural parts exposed to intermediate temperatures of up to about 200° C., such as required in automobile, aircraft or spacecraft applications.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

The invention provides a low density aluminum-base alloy, consisting essentially of the formula $Al_{bal}Zr_aLi_bMg_cT_d$, wherein T is at least one element selected from the group consisting of Cu, Si, Sc, Ti, V, Hf, Be, Cr, Mn, Fe, Co and Ni, "a" ranges from about 0.25–2 wt %, "b" ranges from about 2.7–5 wt %, "c" ranges from about 0.5–8 wt %, "d" ranges from about 0.5–5% and the balance is aluminum.

The alloys contain selected amounts of lithium and magnesium to provide high strength and low density. In addition, the alloys contain secondary elements to provide ductility and fracture toughness. Elements, such as copper, are employed to provide superior precipitation hardness response; and elements, such as silicon and transition metal elements, are employed to provide improved thermal stability at intermediate temperatures up to about 200° C. Zirconium, preferably in a minimum amount of approximately 0.4 wt %, is employed to provide grain size control by pinning the grain boundaries during thermomechanical processing. Preferred alloys may also contain about 3–4.5 wt % Li, about 1.5–3 wt % Cu and up to about 6 wt % Mg.

Alloys of the invention are produced by rapidly quenching and solidifying a melt of a desired composition at a rate of at least about $10^5$° C./sec onto a moving, chilled casting surface. The casting surface may be, for example, the peripheral surface of a chill roll or the chill surface of an endless casting belt. Preferably, the casting surface moves at a speed of at least about 9,000 feet/minute (2750 m/min) to provide a cast alloy strip approximately 30–40 micrometers in thickness, which has been uniformly quenched at the desired quench rate. Such strip can be 4 inches or more in width, depending upon the casting method and apparatus employed. Suitable casting techniques include, for example, jet casting and planar flow casting through a slot-type orifice. The strip is cast in an inert atmosphere, such as an argon atmosphere, and means are employed to deflect or otherwise disrupt the high speed boundary layer moving along with the high speed casting surface. The disruption of the boundary layer ensures that the cast strip maintains contact with the casting surface and is cooled at the required quench rate. Suitable disruption means include vacuum devices around the casting surface and mechanical devices that impede the boundary layer motion. Other rapid solidification techniques, such as melt atomization and quenching processes, can also be employed to produce the alloys of the invention in non-strip form, provided the technique produces a uniform quench rate of at least about $10^{5}$° C./sec.

Figure 1:
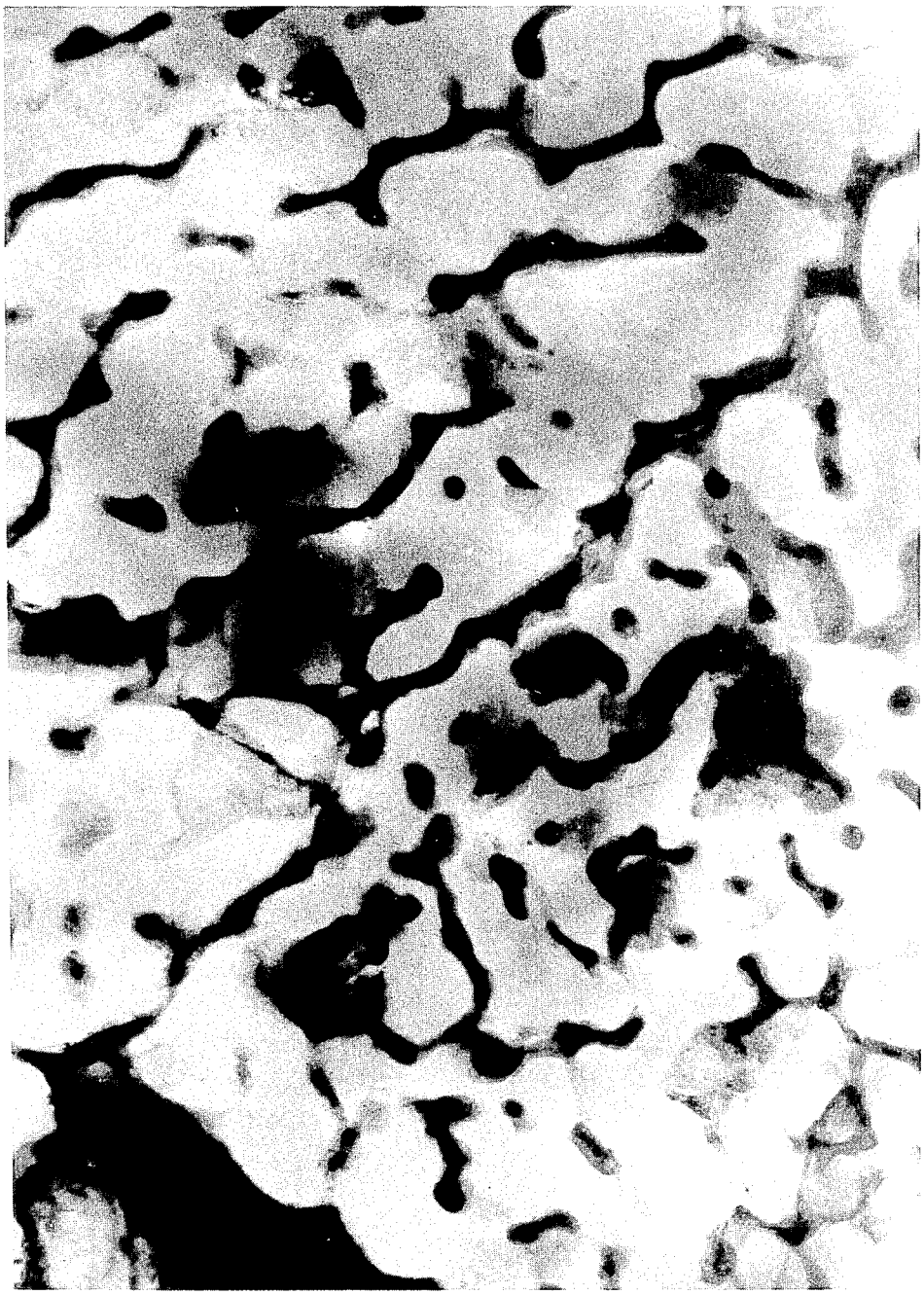
FIG. 1 shows a transmission electron micrograph of the microstructure of an alloy (Al-4Li-3Cu-1.5Mg-0.2Zr) which has been cast into strip form and heat treated at about 350° C. for approximately 1 hr.

Under the proper quenching conditions, the alloys of the invention have a distinctive microstructure which includes very fine intermetallic phases of the constituent elements dispersed in a primary, uniform, cellular-dendritic, fine-grain supersaturated aluminum alloy solid solution phase (FIG. 1). For the purposes of the present invention, a "cell" is a portion of the lighter colored region which can be viewed as being irregularly "partitioned" by extensions of the dark, filamentary regions. The cell size of the aluminum alloy solid solution phase is not more than about 0.5 micrometers; the width of the intermetallic phase (dark filamentary regions) is not more than about 100 nm and preferably ranges from about 1.0–50 nm.

Alloys having the above described microstructure are particularly useful for forming consolidated articles employing conventional powder metallurgy techniques, which include direct powder rolling, vacuum hot compaction, blind-die compaction in an extrusion press or forging press, direct and indirect extrusion, impact forging, impact extrusion and combinations of the above. After comminution to suitable particle size of about −60 to 200 mesh, the alloys are compacted in a vacuum of less than about $10^{-4}$ torr ($1.33\times10^{-2}$ Pa) preferably about $10^{-5}$ torr, and at a temperature of not more than about 400° C., preferably about 375° C. to minimize coarsening of the intermetallic, zirconium-rich phases.

The compacted alloy is solutionized by heat treatment at a temperature ranging from about 500° to 550° C. for a period of approximately 0.5 to 5 hours to convert elements, such as Cu, Mg, Si and Li, from microsegregated and precipitated phases into the aluminum solid solution phase. This solutionizing step also produces an optimized distribution of $ZrAl_3$ particles ranging from about 100 to 500 Angstroms (10 to 50 nm) in size, as representatively shown in FIG. 2. The alloy article is then quenched in a fluid bath, preferably held at approximately 0° to 80° C., and optionally, stretched to produce a tensile strain therein of approximately 2% elongation prior to any ageing or precipitation hardening. This stretching step enhances the number of potential dislocation sites within the alloy and significantly improves the ductility of the final consolidated article. The compacted article is aged at a temperature ranging from about 100° to 250° C. for a period ranging from about 1 to 40 hours to provide selected strength/toughness tempers. Under-ageing the compacted article, at about 120° C. for about 24 hr., produces a tough article. Peak-ageing, at about 150° C. for about 16 to 20 hr., produces a strong (T6x) article. Over-ageing, at about 200° C. for about 10 to 20 hr., produces a corrosion resistant (T7x) article.

Figure 4A:
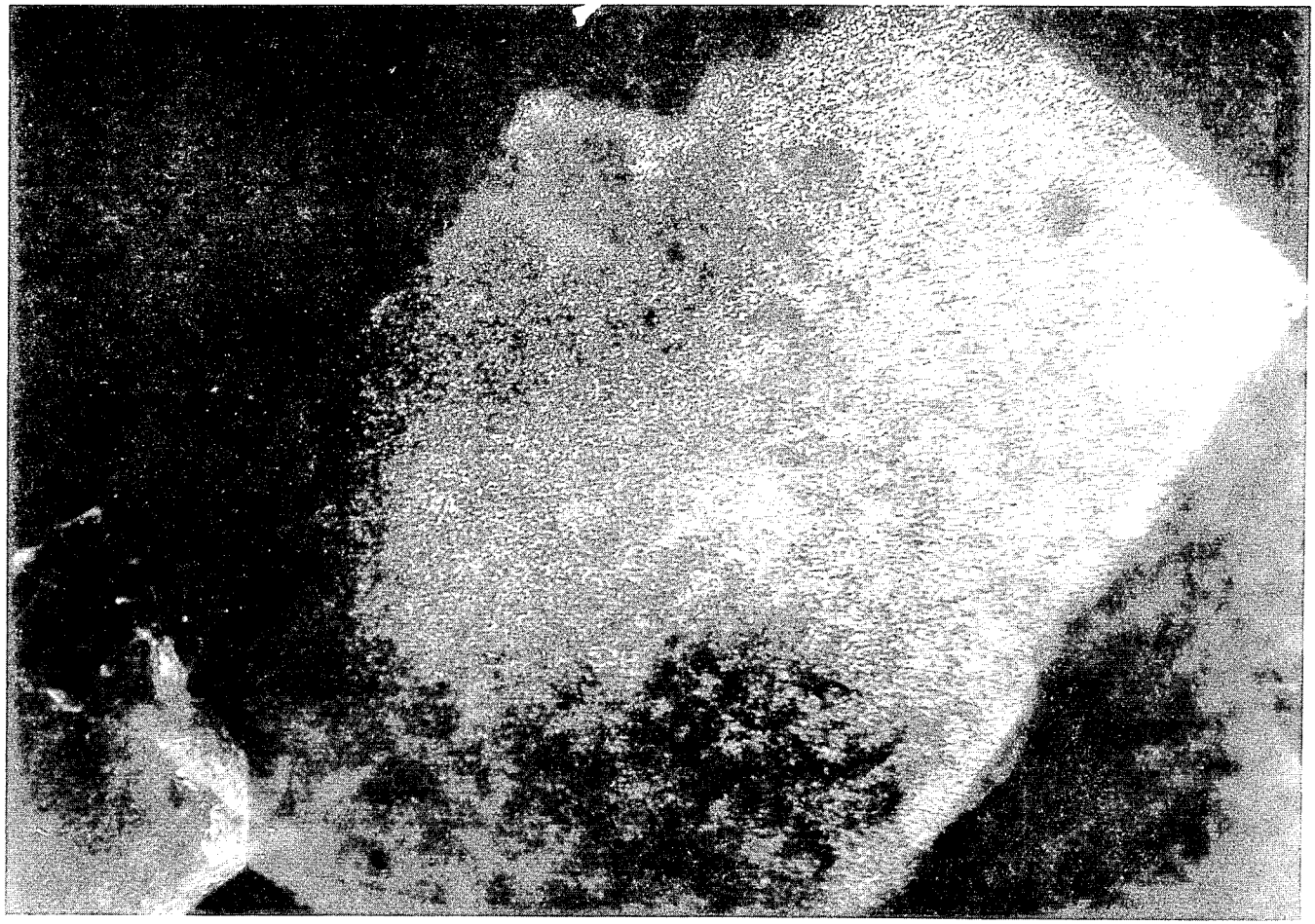
FIG. 4*a* shows a transmission electron micrograph (TEM) of a representative alloy of the invention (Al-4Li-1.5Cu-1.5Mg-0.5Zr) which has been formed into a consolidated article by extrusion and has been precipitation hardened by the δ' ($Al_3Li$,Zr) phase.

The consolidated article of the invention has a distinctive microstructure, as representatively shown in FIG. 4*a*, which is composed of an aluminum solid solution containing therein a substantially uniform and highly dispersed distribution of intermetallic precipitates. These precipitates are essentially composed of fine $Al_3(Li,Zr)$ intermetallic particles containing Mg and Cu and measuring not more than about 5 nm along the largest linear dimension thereof.

The consolidated articles have an ultimate tensile strength ranging from about 450 to 600 MPa and have a hardness ranging from about 70 to 90 $R_B$. In addition, the consolidated articles advantageously have an ultimate tensile strain at fracture ranging from about 5 to 8% elongation and a high elastic modulus of about $80–95\times10^{6}$ kPa) ($11.6–12.3\times10^{6}$ psi).

Preferred consolidated articles have a 0.2% yield strength of at least about 345 MPa (50 Ksi) and a ductility of about 10% elongation to fracture, when measured at a temperature of about 177° C. (350° F).

The consolidated article of this invention, generally has a very fine grain-size after consolidation. The grain-size is typically much finer than that of conventional ingot metallurgy alloys. A characteristic feature of such a fine grain size, typically about 5 micrometers but varying from 1 to 10 micrometers, is the ability of the alloy to undergo extensive deformation at low stresses and high temperatures of about 400° C. or greater. This is commonly referred to as "superplasticity". For the present invention, the superplastic response can be directly attributed to the actual zirconium content of the alloy and the distribution of $ZrAl_3$ particles produced during consolidation. The superplasticity advantageously improves the ability to reshape the consolidated article employing known manufacturing techniques.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES 1–29

Alloys of the invention having compositions listed in Table I below have been prepared.

TABLE I

| | |
|---|---|
| 1. | Al—4Li—3Cu—1.5Mg—0.5Zr |
| 2. | Al—4Li—3Cu—1.5Mg—0.75Zr |
| 3. | Al—4Li—3Cu—1.5Mg—1.0Zr |
| 4. | Al—4Li—3Cu—1.5Mg—1.25Zr |
| 5. | Al—4Li—3Cu—1.5Mg—1.5Zr |
| 6. | Al—4Li—2Cu—2Mg—0.5Zr |
| 7. | Al—3.5Li—2.0Cu—2.0Mg—0.5Zr |
| 8. | Al—4Li—2.0Cu—1.5Mg—0.5Zr |
| 9. | Al—4Li—1.5Cu—1.5Mg—0.5Zr |
| 10. | Al—4Li—1.5Cu—2.0Mg—0.5Zr |
| 11. | Al—4Li—5Mg—0.5Cu—0.5Zr |
| 12. | Al—4Li—4Mg—0.5Cu—0.5Zr |
| 13. | Al—4Li—4Mg—1Cu—0.5Zr |
| 14. | Al—4Li—3Mg—1Cu—0.5Zr |
| 15. | Al—4Li—3Mg—1.5Cu—0.5Zr |
| 16. | Al—4Li—2Mg—1Cu—0.5Zr |
| 17. | Al—4Li—1Mg—1Cu—0.5Zr |
| 18. | Al—4Li—1Mg—2Cu—0.5Zr |
| 19. | Al—4Li—5Mg—1V—0.5Zr |
| 20. | Al—3.5Li—5Mg—0.5Cu—0.5Zr |
| 21. | Al—3.5Li—4Mg—0.5Cu—0.5Zr |
| 22. | Al—3.5Li—6Mg—0.5Cu—0.5Zr |
| 23. | Al—3.5Li—4Mg—1Cu—0.5Zr |
| 24. | Al—3.5Li—3Mg—0.5Cu—0.5Zr |
| 25. | Al—3.5Li—3Mg—1Cu—0.5Zr |
| 26. | Al—3.5Li—3Mg—1.5Cu—0.5Zr |
| 27. | Al—3.5Li—2Mg—1Cu—0.5Zr |
| 28. | Al—3.5Li—1Mg—1Cu—0.5Zr |
| 29. | Al—3.5Li—1Mg—2Cu—0.5Zr |

EXAMPLE 30

The ability of the zirconium to control the size of the aluminum-lithium-copper-magnesium-zirconium intermetallics during thermomechanical processing is illustrated by the following examples.

FIG. 1 shows a transmission electron micrograph of the microstructure of a representative alloy (Al-4Li-3Cu-1.5Mg-0.2Zr) which had been cast into strip form and heat treated at 350° C. for 1 hr. Such heat treatment considerably coarsens the microstructure; the intermetallic phases containing the elements responsible for strengthening, such as lithium, copper and magnesium become relatively more coarse and measured approximately 1000 Angstroms (0.1 micrometer) across their smallest linear dimension.

Figure 2:
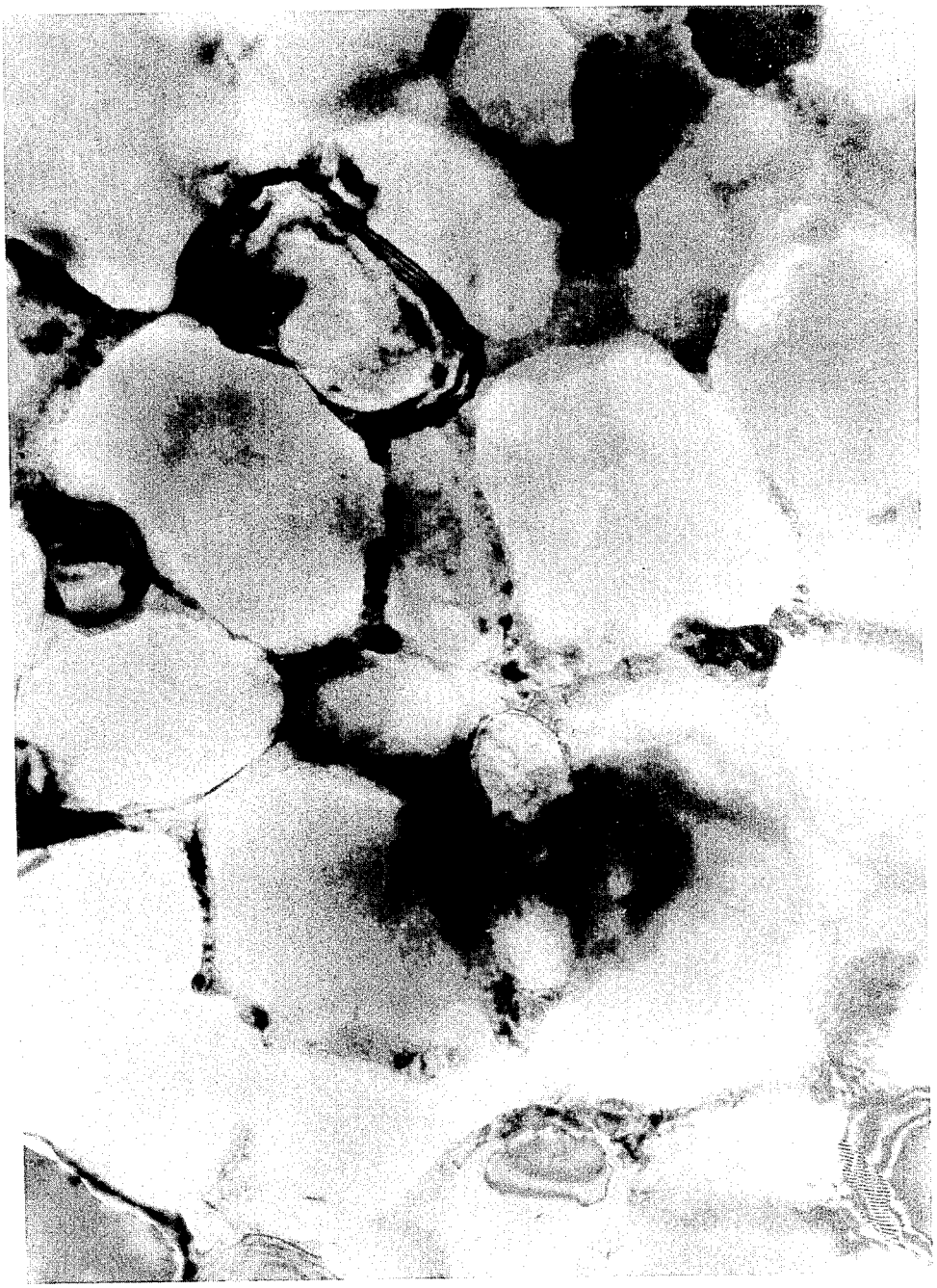
FIG. 2 illustrates an alloy (Al-4Li-3Cu-1.5Mg-0.2Zr) which has been heat treated, after casting into strip form, at about 350° C. for approximately 4 hrs.

FIG. 2 illustrates a representative alloy (Al-4Li-3Cu-1.5Mg-0.2Zr) which had been heat treated, after being cast into strip form, for 4 hr. at 350° C. This heat treatment produced intermetallic phase particles which measure approximately 2000 Angstroms (0.2 micrometer) across their smallest dimensions.

Figure 3:
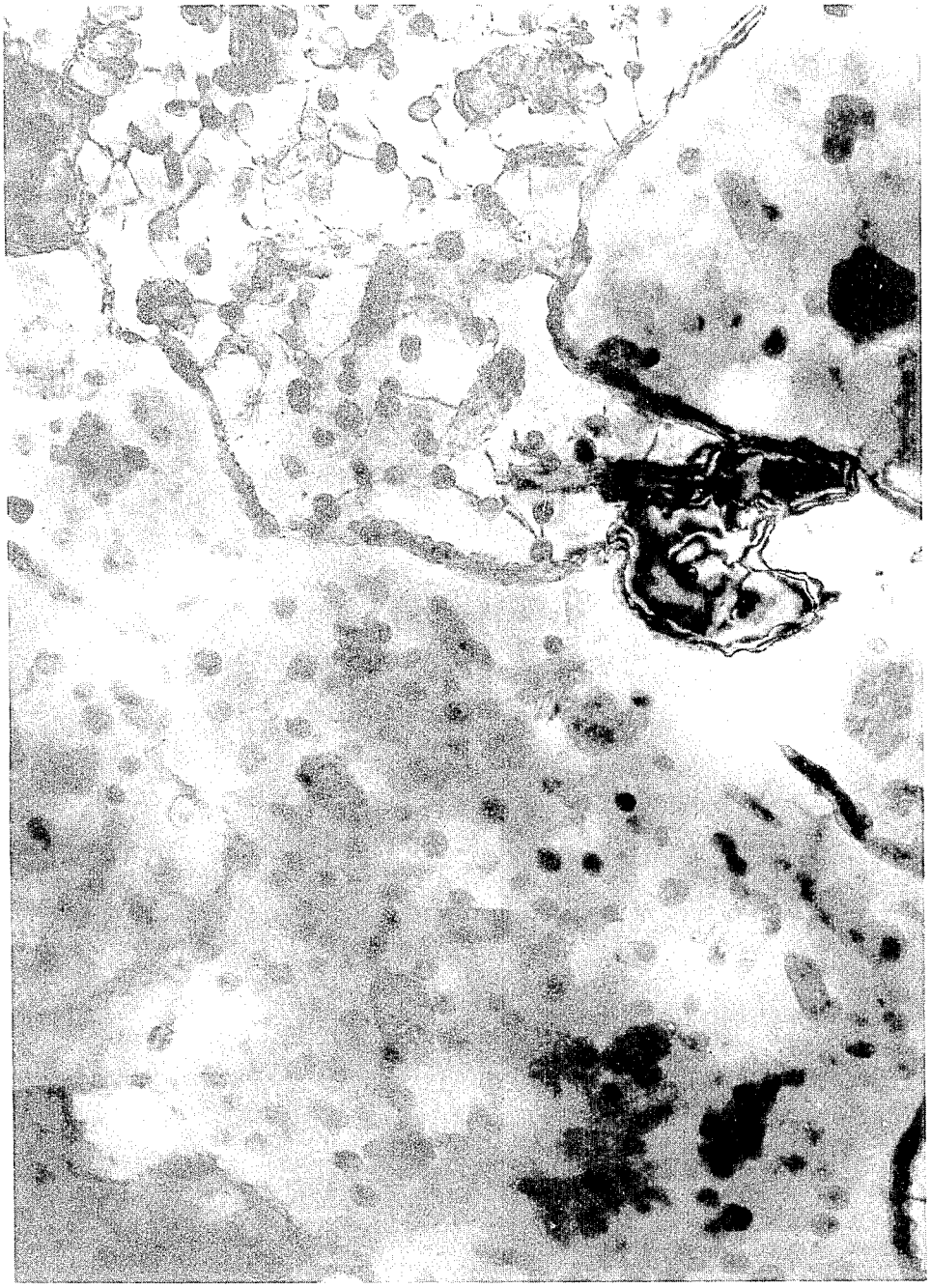
FIG. 3 shows a representative alloy of the invention (Al-4Li-3Cu-1.5Mg-1.25Zr) which has been heat treated at about 350° C. for approximately 2 hr.

In contrast, FIG. 3 illustrates the beneficial effect of a higher zirconium content (1.25 wt %) in an alloy having the composition Al-4Li-3Cu-1.5Mg-1.25Zr. In this alloy, the intermetallic phases were considerably finer after the alloy had been subjected to heat treatment at 350° C. for 2 hr. The intermetallics measured less than about 200 μ (20 nm) across their largest linear dimension. These intermetallics are about 5 to 10 times smaller than the intermetallics present in the alloy shown in FIGS. 1 and 2, where the zirconium content was 0.2 wt %.

EXAMPLE 31

Alloys listed in Table II were formed into consolidated articles in accordance with the method of the invention and exhibited the properties indicated in the Table.

TABLE II

| Alloy Composition | Al—3.5Li—2Cu—2Mg—0.5Zr | Al—4Li—1.5Cu—1.5Mg—0.5Zr | Al—4Li—2Cu—2Mg—0.5Zr |
|---|---|---|---|
| Vacuum Hot Compaction | 350° C. | 350° C. | 350° C. |
| Extrusion | 385° C.<br>18.1 Reduction | 385° C.<br>18.1 | 385° C.<br>18.1 |
| Solution Treatment | 545° C.<br>4 hrs. | 545° C.<br>4 hrs. | 540° C.<br>4 hrs. |
| Precipitation Treatment | 150° C.<br>16 hrs. | 120° C.<br>24 hrs. | 215° C.<br>4 hrs. |
| Ultimate Tensile Strength | 81 Ksi | 74 Ksi | 73 Ksi |
| 0.2% Yield Strength | 64 Ksi | 57 Ksi | 62 Ksi |
| Elongation Strain to Fracture | 5% | 5% | 6.6% |

EXAMPLE 32

This example illustrates the importance of an optimized amount of zirconium in providing increased strength and increased ductility. The presence of zirconium in the amounts called for by the present invention, controls the size distribution of the zirconium rich $ZrAl_3$ phases, controls the subsequent aluminum matrix grain size, and controls the coarsening rate (Oswald ripening) of other aluminum-rich intermetallic phases. These phases contain smaller amounts of zirconium but predominantly contain aluminum, lithium, copper and magnesium. The three alloys set forth in Table III, containing up to 0.75 wt % Zr were cast into strip form at a quench rate of at least about $10^{6}$° C./sec, comminuted into powder, vacuum hot compacted and extruded at about 385° C. into rectangular bars. The bars were then solution treated at 546° C. for about 4 hours, quenched into water at about 20° C. and aged for about 24 hours at approximately 120° C. The resulting tensile properties, set forth in the Table, show that increasing Zr contents increase both strength and ductility.

TABLE III

| Composition | 0.2% Yield Strength | Ultimate Tensile Strength | % Elongation to Fracture |
|---|---|---|---|
| Al—4Li—3Cu—1.5Mg—0.2Zr | 55 Ksi | 68 Ksi | 4 |
| Al—4Li—3Cu—1.5Mg—0.5Zr | 55 Ksi | 68 Ksi | 4 |
| Al—4Li—3Cu—1.5Mg—0.75Zr | 61 Ksi | 74 Ksi | 5 |

Various modifications of these basic strength properties have been achieved by varying heat treatment conditions. For example, with the alloys containing 4 wt % Li, a heat treatment at 150° C. for about 16 hours produced yield strengths of about 79 ksi and ultimate elongations of about 5%. As a result, varying heat treatments of the alloys of the invention can be employed to produce alloys and articles having controlled degrees of fracture toughness.

EXAMPLE 33

Figure 4B:
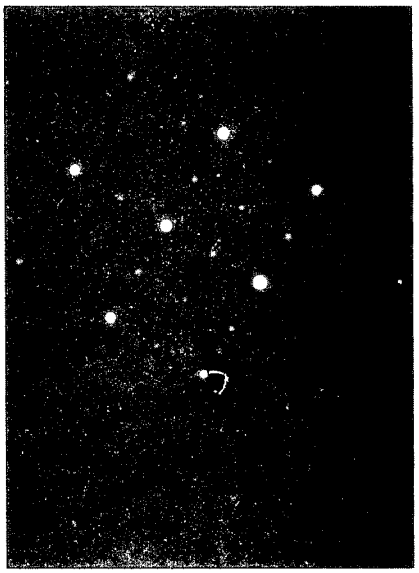
FIG. 4*b* shows the electron diffraction pattern of the article of FIG. 4*a;*
Figure 4C:
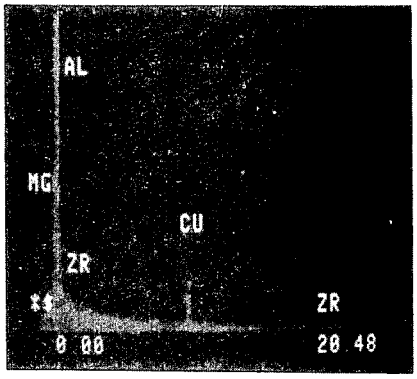
FIG. 4*c* shows the backscattered X-ray energy spectrum of the alloy shown in FIG. 4*a;*

FIG. 4*a* shows a transmission electron micrograph of a representative alloy of the invention (Al-4Li-1.5Cu-1.5Mg-0.5Zr) which has been formed into a consolidated article by extrusion and has been precipitation hardened by the δ' ($Al_3Li$,Zr) phase. In FIG. 4*a*, the precipitates are seen as small, dark, irregularly shaped particles dispersed within the lighter aluminum solid solution region. The electron diffraction pattern of the alloy article shown in FIG. 4*b* exhibits the characteristic $Ll_2$ phase superlattice diffraction pattern. The backscattered X-ray energy spectrum shown in FIG. 4*c*, particularly the closeness in relative intensity between the Al line and the primary Zr line, shows the presence of zirconium predominantly in the Al alloy solid solution. More than 50% of the total Zr content of the alloy is in the Al solid solution and the δ' phase.

Table IV shows a representative variation in properties of an Al-4Li-1.5Cu-1.5Mg-0.5 Zr alloy after different heat treatment times and temperatures.

TABLE IV

| | 0.2% Yield Strength | UTS | Elongation to Fracture |
|---|---|---|---|
| A. Solution treatment at 540° C. for 4 hr. and aged at 130° C. for | 66.3 Ksi | 80.3 Ksi | 5% |

TABLE IV-continued

| | 0.2% Yield Strength | UTS | Elongation to Fracture |
|---|---|---|---|
| 24 hr. | | | |
| B. Solution treatment at 540° C. for 8 hr. and aged at 160° C. for 16 hr. | 68.8 Ksi | 81.6 Ksi | 5% |

Figure 5:
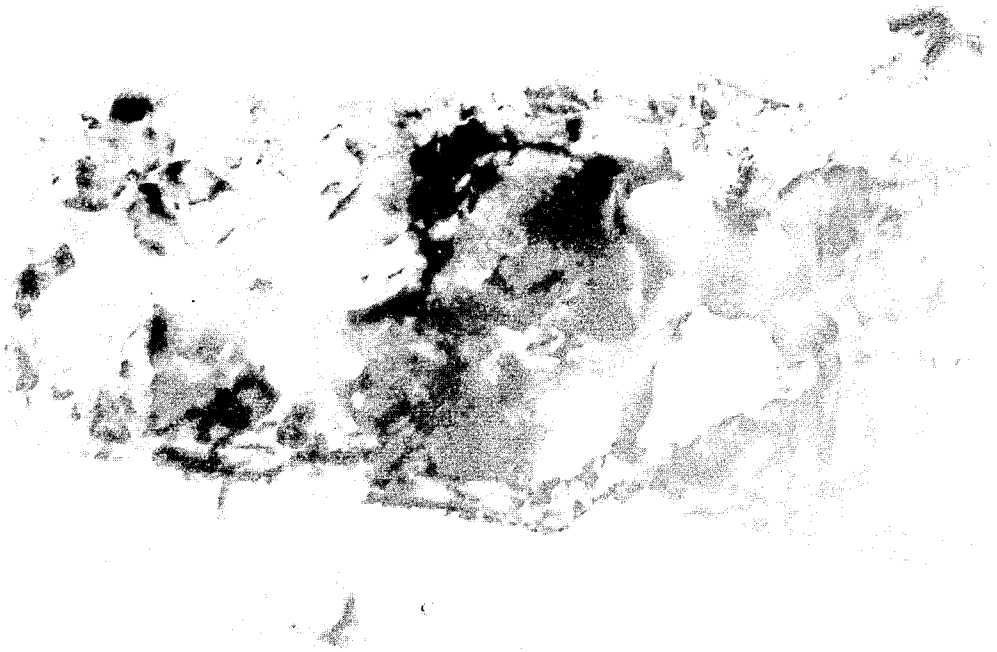
FIG. 5 shows a transmission electron micrograph of a portion of a tensile test specimen composed of Al-4Li-1.5Cu-1.5Mg-0.5Zr.

After deformation, the alloys of the invention exhibit cellular dislocation networks, as representatively shown in FIG. 5. Such dislocation networks are not typical of conventional binary aluminum lithium alloys or quaternary Al-Li-Cu-Mg alloys. Ordinarily, such conventional alloys exhibit planar slip, and exhibit very few free dislocations or dislocation networks in the peak strengthened (T6) condition. In contrast to such conventional alloys, the alloys of the invention include zirconium in the alloy strengthening phase at levels greater than has been possible in the solid solubility limited, conventional alloys. This advantageously modifies precipitate interfacial strain and precipitate strain fields, and provides increased free dislocation activity and increased ductility in the alloys of the invention.

EXAMPLE 34

Table V shows representative properties of an Al-4Li-3Cu-1.5Mg-0.45Zr alloy tested at 177° C. (350° F.) after heat treatment, in comparison to a conventional aluminum alloy used at such temperatures, for example, 2219-T851.

TABLE V

| | 0.2% Yield Strength | UTS | % Elongation to Fracture |
|---|---|---|---|
| Solution treatment at 540° C. for 1 hour | 49 Ksi | 53 Ksi | 9.5 |
| Solution treatment at 540° C. for 1 hour, and Aged at 150° C. for 16 hours | 61.4 Ksi | 64.6 Ksi | 10.6 |
| Alloy 2219 - T851 heat treatment | 39.6 Ksi | 42 Ksi | 10 |

EXAMPLES 35-37

Table VI shows representative properties of three alloys of the invention over a temperature range encountered by Mach 2 aircraft flying at both sea-level and high altitude, ie from 77 to 450K. The properties shown in Table VI are for alloys in the solution treated condition, after heat treatment at 540° C. for 1 hour followed by water quenching.

TABLE VI

| | Liq. $N_2$ 77K | 70° F. 300K | 350° F. 450K |
|---|---|---|---|
| Al—4Li—3Cu—1.5Mg—0.5Zr | | | |
| 0.2% YS (Ksi) | 45.11 | 43.26 | 48.79 |
| UTS (Ksi) | 59.2 | 59.36 | 53.44 |
| $E_f$(%) | 10.3 | 5.5 | 9.5 |
| Al—3.5Li—2Cu—2Mg—0.5Zr | | | |
| 0.2% YS (Ksi) | 49.81 | 45.94 | 49.08 |
| UTS (Ksi) | 64.14 | 65.44 | 53.73 |
| $E_f$(%) | 9.3 | 6.8 | 7.3 |
| Al—4Li—1.5Cu—1.5Mg—0.5Zr | | | |
| 0.2% YS (Ksi) | 50.92 | 47.26 | 47.33 |
| UTS (Ksi) | 60.47 | 59.60 | 50.68 |
| $E_f$(%) | 5.0 | 4.0 | 8.5 |

EXAMPLE 38

At temperatures above 450K (350° F.) alloys of this invention display increasing tensile elongations to fracture with increasing temperature, culminating in elongations greater than 100% at temperatures around 675K (400° C., 750° F.). This phenomena of increased tensile elongations, above 100%, at low deformation stresses, such 10 MPa to 20 MPa (a few thousand pounds per square inch), is known as superplasticity.

Figure 6:
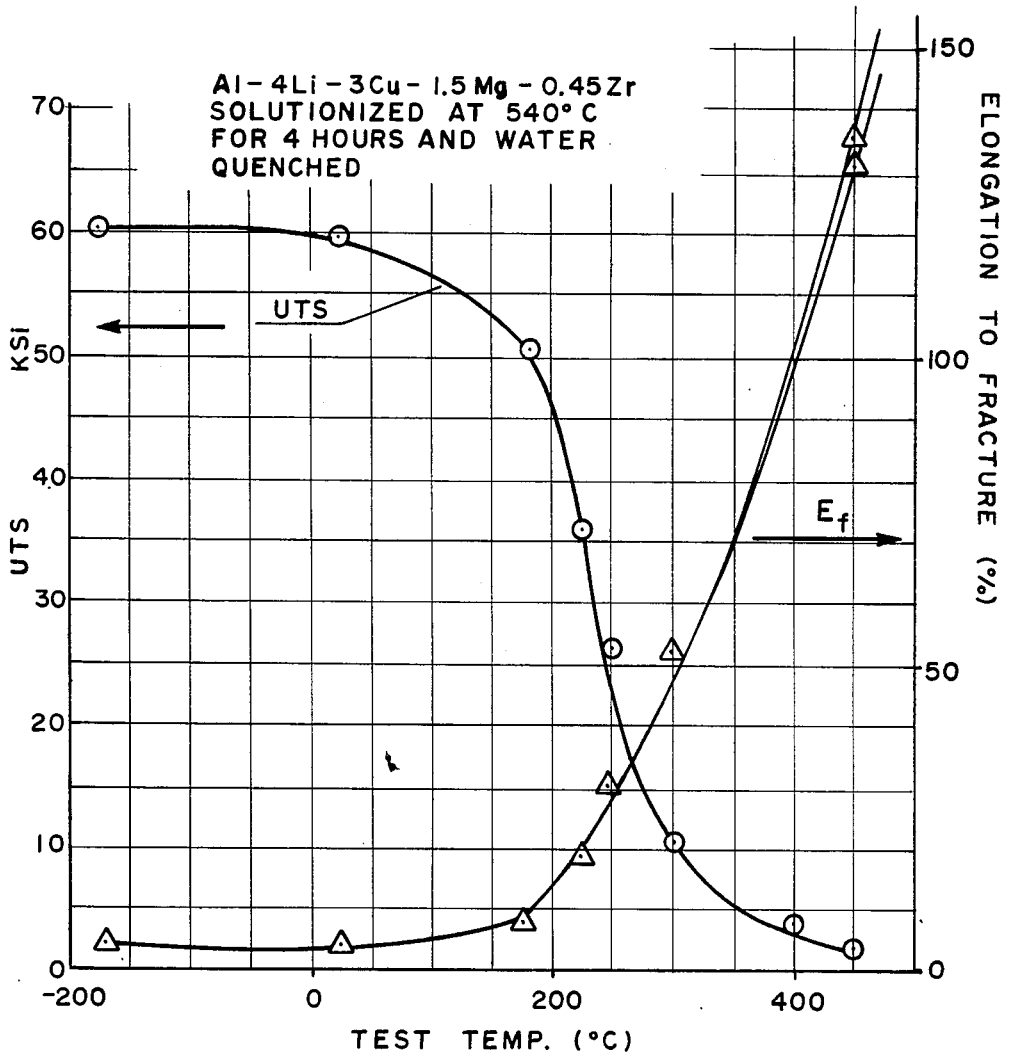
FIG. 6 shows plots of strength and ductility ($E_f$) as a function of temperature for the alloy Al-4Li-3Cu-1.5Mg-0.45Zr in the solution treated condition.

FIG. 6 shows a plot of strength and elongation to fracture as a function of temperature for the alloy Al-4Li-3Cu-1.5Mg-0.45Zr in the solution treated condition. The figure illustrates the superplastic behaviour of the alloy at 450° C. (723K, 840° F.) where deformation at a flow stress of about 13 MPa (1.9 Ksi) produced a tensile elongation of 137%.

Having thus described the invention in rather full detail, it will be understood that these details need not be strictly adhered to but that various changes and modifications may suggest themselves to one skilled in the art, all falling within the scope of the invention as defined by the subjoined claims.

What is claimed is:

1. A low density aluminum-base alloy, consisting essentially of the formula $Al_{bal}Zr_aLi_bMg_cT_d$, wherein T is at least one element selected from the group consisting of Cu, Si, Sc, Ti, V, Hf, Be, Cr, Mn, Fe, Co and Ni, "a" ranges from about 0.25–2 wt %, "b" ranges from about 2.7–5 wt %, "c" ranges from about 0.5–8 wt %, "d" ranges from about 0.5–5 wt % and the balance is aluminum, said alloy being composed of a primary, cellular-dendritic, fine-grain, supersaturated aluminum alloy solid solution phase with filamentary intermetallic phases of the consituent elements dispersed therein, said intermetallic phases having width dimensions of not more than about 100 nm.

2. An alloy as recited in claim 1, wherein "T" consists of Cu and "d" ranges from about 1.5–3 wt %.

3. An alloy as recited in claim 1, wherein "b" ranges from about 3–4.5 wt %.

4. An alloy as recited in claim 2, wherein "b" ranges from about 3–4.5 wt %.

5. An alloy as recited in claim 1, wherein "c" ranges from about 0.5–6 wt %.

6. A method for producing a low-density, aluminum alloy, consolidated articles, comprising the steps of:

compacting particles composed of a low density aluminum-base alloy, consisting essentially of the formula $Al_{bal}Zr_aLi_bMg_cT_d$, wherein T is at least one element selected from the group consisting of Cu, Si, Sc, Ti, V, Hf, Be, Cr, Mn, Fe, Co and Ni, "a" ranges from about 0.25–2 wt %, "b" ranges from about 2.7–5 wt %, "c" ranges from about 0.5–8 wt %, "d" ranges from about 0.5–5% and the balance is aluminum, said alloy having a primary, cellular dendritic, fine-grain, supersaturated aluminum alloy solid solution phase with filamentary, intermetallic phases of the constituent elements dispersed therein, and said intermetallic phases having width dimensions of not more than about 100 nm;

heating said alloy during said compacting step to a temperature of not more than about 400° C. to minimize coarsening of said intermetallic phases;

solutionizing said compacted alloy by heat treatment at a temperature ranging from about 500° to 550° C. for a period of approximately 0.5 to 5 hrs to convert elements from micro-segregated and precipitated phases into said aluminum solid solution phase; and quenching said compacted alloy in a fluid bath.

7. A method as recited in claim 6, further comprising the step of ageing said compacted alloy at a temperature ranging from about 100°-250° C. for a period ranging from about 1-40 hr.

8. A method as recited in claim 6 further comprising the step of stretching said compacted alloy to enhance the number of potential dislocation sites withih said alloy.

9. A consolidated article produced in accordance with a method as recited in claim 6.

10. A consolidated article produced in accordance with a method as recited in claim 7.

11. A consolidated article as recited in claim 10, having a density of not more than about 2.6 gm/cc, an ultimate tensile strength of at least about $450\times10^3$ kPa and an ultimate tensile strain to fracture of at least about 5% elongation, measured at a temperature of about 20° C.

12. A consolidated article composed of particles of an alloy consisting essentially of the formula $Al_{bal}Zr_aLi_bMg_cT_d$, wherein T is at least one element selected from the group consisting of Cu, Si, Sc, Ti, V, Hf, Be, Cr, Mn, Fe, Co and Ni, "a" ranges from about 0.25-2 wt %, "b" ranges from about 2.7-5 wt %, "c" ranges from about 0.5-8 wt %, "d" ranges from about 0.5-5 wt % and the balance is aluminum, said alloy having a microstructure composed of an aluminum solid solution phase containing therein a substantially uniform dispersion of fine intermetallic precipitates, and said precipitates measuring not more than about 20 nm along the largest linear dimension thereof.

13. A consolidated article as recited in claim 12, wherein said alloy group T consists of Cu and "d" ranges from about 1.5-3 wt %.

14. A consolidated article as recited in claim 12, wherein "b" ranges from about 3-4.5 wt %.

15. A consolidated article as recited in claim 13, wherein "b" ranges from about 3-4.5 wt %.

16. A consolidated article as recited in claim 12 having a density of not more than 2.6 gm/cc, an ultimate tensile strength of at least about $450\times10^3$ KPa and an ultimate strain at fracture of at least about 5% elongation, measured at a temperature of about 20° C.

17. A consolidated article as recited in claim 12 capable of a tensile elongation to fracture of at least about 100% when measured at a temperature of at least about 400° C.

18. A consolidated article as recited in claim 12, having a 0.2% yield strength of at least about 345 MPa(50 Ksi) and a ductility of about 10% elongation to fracture, measured at a temperature of about 177° C.

19. An alloy as recited in claim 2, wherein "c" ranges from about 0.5-6 wt %.

20. A consolidated article as recited in claim 12, wherein "c" ranges from about 0.5-6 wt %.

21. A consolidated article as recited in claim 13, wherein "c" ranges from about 0.5-6 wt %.

22. A consolidated article as recited in claim 14, wherein "c" ranges from about 0.5-6 wt %.

23. A consolidated article as recited in claim 15, wherein "c" ranges from about 0.5-6 wt %.

24. A consolidated article as recited in claim 13, having a density of not more than 2.6 gm/cc, an ultimate tensile strength of at least about $450\times10^3$ KPa and an ultimate strain at fracture of at least about 5% elongation, measured at a temperature of about 20° C.

25. A consolidated article as recited in claim 14, having a density of not more than 2.6 gm/cc, an ultimate tensile strength of at least about $450\times10^3$ KPa and an ultimate strain at fracture of at least about 5% elongation, measured at a temperature of about 20° C.

26. A consolidated article as recited in claim 15, having a density of not more than 2.6 gm/cc, an ultimate tensile strength of at least about $450\times10^3$ KPa and an ultimate strain at fracture of at least about 5% elongation, measured at a temperature of about 20° C.

27. A consolidated article as recited in claim 20, having a density of not more than 2.6 gm/cc, an ultimate tensile strength of at least about $450\times10^3$ KPa and an ultimate strain at fracture of at least about 5% elongation, measured at a temperature of about 20° C.

28. A consolidated article as recited in claim 21, having a density of not more than 2.6 gm/cc, an ultimate tensile strength of at least about $450\times10^3$ KPa and an ultimate strain at fracture of at least about 5% elongation, measured at a temperature of about 20° C.

29. A consolidated article as recited in claim 22, having a density of not more than 2.6 gm/cc, an ultimate tensile strength of at least about $450\times10^3$ KPa and an ultimate strain at fracture of at least about 5% elongation, measured at a temperature of about 20° C.

30. A consolidated article as recited in claim 23, having a density of not more than 2.6 gm/cc, an ultimate tensile strength of at least about $450\times10^3$ KPa and an ultimate strain at fracture of at least about 5% elongation, measured at a temperature of about 20° C.

31. A consolidated article as recited in claim 13, capable of a tensile elongation to fracture of at least about 100% when measured at a temperature of at least about 400° C.

32. A consolidated article as recited in claim 14, capable of a tensile elongation to fracture of at least out 100% when measured at a temperature of at least about 400° C.

33. A consolidated article as recited in claim 15, capable of a tensile elongation to fracture of at least about 100% when measured at a temperature of at least about 400° C.

34. A consolidated article as recited in claim 20, capable of a tensile elongation to fracture of at least about 100% when measured at a temperature of at least about 400° C.

35. A consolidated article as recited in claim 21, capable of a tensile elongation to fracture of at least about 100% when measured at a temperature of at least about 400° C.

36. A consolidated article as recited in claim 22, capable of a tensile elongation to fracture of at least about 100% when measured at a temperature of at least about 400° C.

37. A consolidated article as recited in claim 23, capable of a tensile elongation to fracture of at least about 100% when measured at a temperature of at least about 400° C.

38. A consolidated article as recited in claim 13, having a 0.2% yield strength of at least about 345 MPa (50 Ksi) and a ductility of about 10% elongation to fracture, measured at a temperature of about 177° C.

39. A consolidated article as recited in claim 14, having a 0.2% yield strength of at least about 345 MPa (50

Ksi) and a ductility of about 10% elongation to fracture, measured at a temperature of about 177° C.

40. A consolidated article as recited in claim 15, having a 0.2% yield strength of at least about 345 MPa (50 Ksi) and a ductility of about 10% elongation fracture, measured at a temperature of about 177° C.

41. A consolidated article as recited in claim 20, having a 0.2% yield strength of at least about 345 MPa (50 Ksi) and a ductility of about 10% elongation to fracture, measured at a temperature of about 177° C.

42. A consolidated article as recited in claim 21, having a 0.2% yield strength of at least about 345 MPa (50 Ksi) and a ductility of about 10% elongation to fracture, measured at a temperature of about 177° C.

43. A consolidated article as recited in claim 22, having a 0.2% yield strength of at least about 345 MPa (50 Ksi) and a ductility of about 10% elongation to fracture, measured at a temperature of about 177° C.

44. A consolidated article as recited in claim 23, having a 0.2% yield strength of at least about 345 MPa (50 Ksi) and a ductility of about 10% elongation to fracture, measured at a temperature of about 177° C.

45. A low density aluminum-base alloy as recited in claim 1, wherein "a" ranges from about 0.45–2 wt %.

46. A low density aluminum-base alloy as recited in claim 2, wherein "a" ranges from about 0.45–2 wt %.

47. A low density aluminum base alloy as recited in claim 4, wherein "a" ranges from about 0.45–2 wt %.

48. A low density aluminum-base alloy as recited in claim 12, wherein "a" ranges from about 0.45–2 wt %.

49. A low density aluminum-base alloy as recited in claim 45, wherein "a" ranges from about 0.45–1.25 wt %.

50. A low density aluminum-base alloy as recited in claim 45, wherein "a" ranges from about 0.45–1.25 wt %.

51. A low density aluminum-base alloy as recited in claim 46, wherein "a" ranges from about 0.45–1.25 wt %.

52. A low density aluminum-base alloy as recited in claim 47, wherein "a" ranges from about 0.45–1.25 wt %.

53. A low density aluminum-base alloy as recited in claim 48, wherein "a" ranges from about 0.45–1.25 wt %.

* * * * *